US009847075B2

(12) United States Patent
Hu et al.

(10) Patent No.: US 9,847,075 B2
(45) Date of Patent: Dec. 19, 2017

(54) ELECTRONIC DEVICE FOR DISPLAYING AND ADJUSTING IMAGE LAYERS IN GRAPHICAL USER INTERFACE AND METHOD THEREOF

(71) Applicant: Shenzhen Airdrawing Technology Service Co., Ltd., Shenzhen (CN)

(72) Inventors: Shuang Hu, Shenzhen (CN); Chih-San Chiang, New Taipei (TW); Ling-Juan Jiang, Shenzhen (CN); Hua-Dong Cheng, Shenzhen (CN)

(73) Assignee: Shenzhen Airdrawing Technology Service Co., Ltd, Shenzhen (CN)

( * ) Notice: Subject to any disclaimer, the term of this patent is extended or adjusted under 35 U.S.C. 154(b) by 194 days.

(21) Appl. No.: 14/594,534

(22) Filed: Jan. 12, 2015

(65) Prior Publication Data

US 2016/0155427 A1 Jun. 2, 2016

(30) Foreign Application Priority Data

Nov. 27, 2014 (CN) ..... 2014 1 0706147

(51) Int. Cl.
*G09G 5/00* (2006.01)
*G09G 5/14* (2006.01)

(52) U.S. Cl.
CPC ..... *G09G 5/14* (2013.01); *G09G 2310/0232* (2013.01); *G09G 2340/045* (2013.01); *G09G 2340/12* (2013.01)

(58) Field of Classification Search
None
See application file for complete search history.

(56) References Cited

U.S. PATENT DOCUMENTS

2011/0302528 A1* 12/2011 Starr ..... G06F 3/0481 715/800
2014/0362105 A1* 12/2014 Kocienda ..... G09G 5/02 345/600

FOREIGN PATENT DOCUMENTS

CN 103927086 A 7/2014
TW 201303791 A1 1/2013

* cited by examiner

*Primary Examiner* — Zhengxi Liu
*Assistant Examiner* — Diana Hickey
(74) *Attorney, Agent, or Firm* — ScienBiziP, P.C.

(57) ABSTRACT

A method for displaying a graphical user interface on a display of an electronic device includes obtaining a total number "n" of image layers to be displayed on the display, and determining whether the total number of image layers is greater than two, determining a processing method of a number of processing methods for processing each image layer for displaying each image layer, processing each image layer according to the determined processing method, and displaying the graphical user interface on the display after all of the image layers have been processed. The number of processing methods include size adjustment, obfuscation adjustment, saturation adjustment, and transparency adjustment.

16 Claims, 4 Drawing Sheets

ELECTRONIC DEVICE FOR DISPLAYING AND ADJUSTING IMAGE LAYERS IN GRAPHICAL USER INTERFACE AND METHOD THEREOF

FIELD

The subject matter herein generally relates to an electronic device and method for displaying a graphical user interface on a display.

BACKGROUND

Generally, an electronic device can display a graphical user interface on a display screen. The graphical user interface can include a plurality of image layers.

BRIEF DESCRIPTION OF THE DRAWINGS

Implementations of the present technology will now be described, by way of example only, with reference to the attached figures.

DETAILED DESCRIPTION

Figure 1:
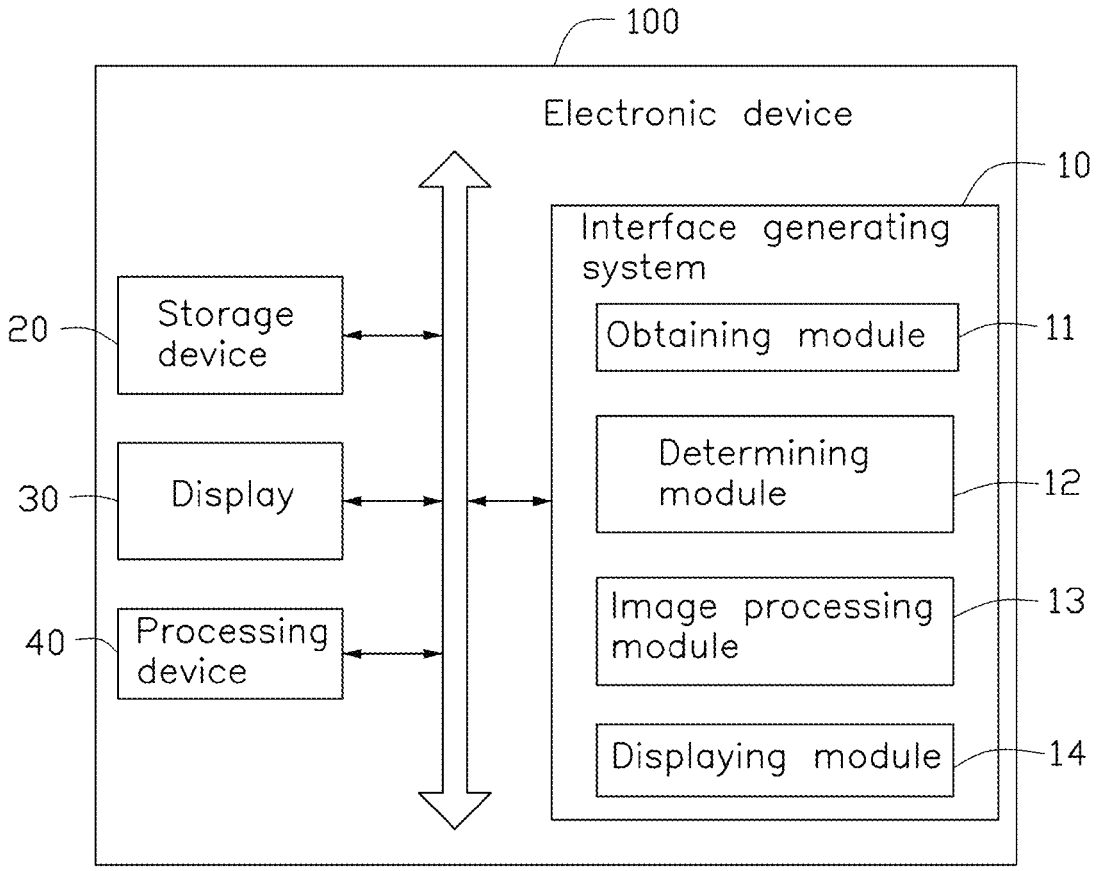
FIG. 1 is a block diagram of an embodiment of an electronic device for displaying a graphical user interface.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "comprising" means "including, but not necessarily limited to"; it specifically indicates open-ended inclusion or membership in a so-described combination, group, series and the like.

In general, the word "module" as used hereinafter refers to logic embodied in hardware or firmware, or to a collection of software instructions, written in a programming language such as, for example, Java, C, or assembly. One or more software instructions in the modules may be embedded in firmware such as in an erasable-programmable read-only memory (EPROM). It will be appreciated that the modules may comprise connected logic units, such as gates and flip-flops, and may comprise programmable units, such as programmable gate arrays or processors. The modules described herein may be implemented as either software and/or hardware modules and may be stored in any type of computer-readable medium or other computer storage device.

FIG. 1 illustrates a block diagram of an embodiment of an electronic device 100 for displaying a graphical user interface. The electronic device 100 can include an interface displaying system 10, a storage device 20, a display 30, and a processing module 40. The graphical user interface can be displayed on the display 30.

The interface displaying system 10 can include an obtaining module 11, a determining module 12, an image processing module 13, and a displaying module 14. The modules 11-14 can include one or more software programs in the form of computerized codes stored in the storage device 20. The computerized codes can include instructions executed by the processing device 40 to provide functions for the modules 11-14.

The obtaining module 11 can obtain a total number "n" of image layers to be displayed on the graphical user interface. In at least one embodiment, a first image layer can be a top-most image layer being operable by a user, a last image layer can be a wallpaper of the graphical user interface, and a second to last image layer can be a plurality of icons on the wallpaper. The obtaining module 11 can determine whether the total number of image layers to be displayed is greater than two.

When the total number of image layers to be displayed is greater than two, the determining module 12 can determine a processing method of a plurality of processing methods for processing each of the total number of image layers. The plurality of processing methods can include size adjustment, saturation adjustment, obfuscation adjustment, and transparency adjustment. In at least one embodiment, each of the image layers from a second image layer to the second to last image layer is processed by size adjustment, each of the image layers from the second image layer to the last image layer is processed by obfuscation and saturation adjustment, and each of the image layers from the first image layer to the last image layer is processed by transparency adjustment.

The image processing module 13 can process each image layer according to the processing methods determined by the determining module 12.

To adjust the size of each of the image layers from the second image layer to the second to last image layer, the image processing module 13 first reduces the size of the second image layer by a predetermined proportion "r". The rest of the image layers can be processed according to the following formula:

$$[r-(i-2)*\Delta r]$$

wherein:

$r<1$;

$\Delta r$ is a predetermined step reduction value of r for each consecutive image layer after the second image layer;

i is an integer and equals a sequence number of the image layer;

$2 \le i \le n-1$; and $\Delta r<r/(n-2)$.

Figure 2:
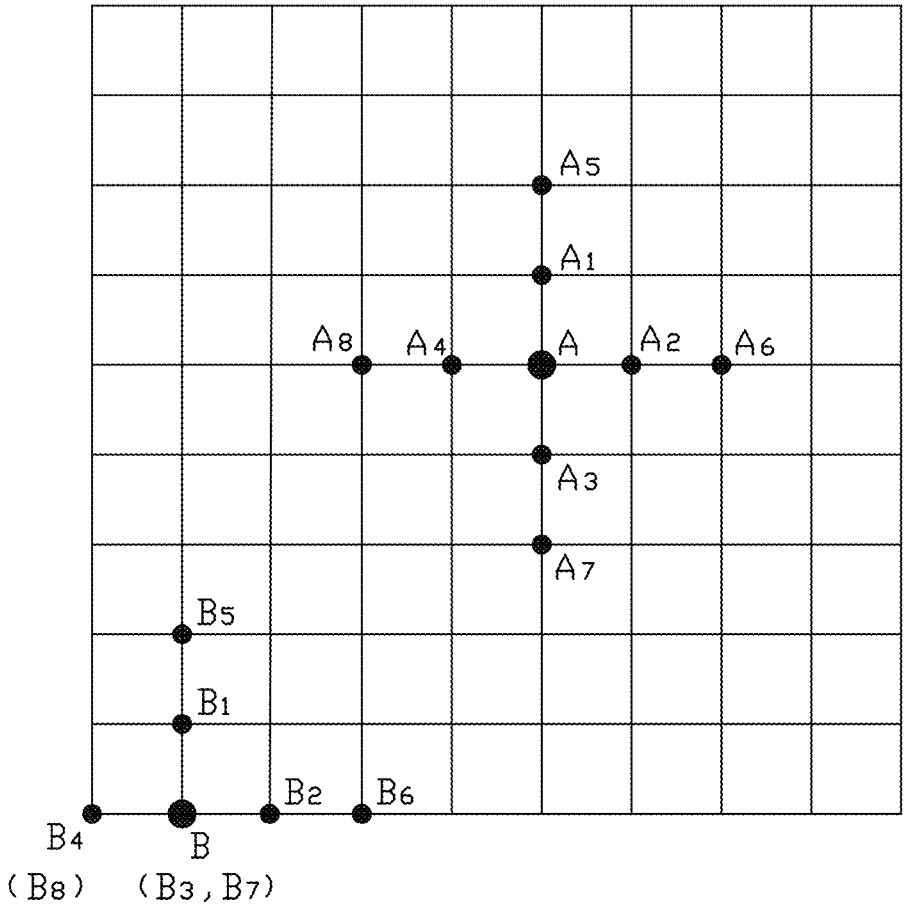
FIG. 2 is a diagrammatic diagram of an embodiment of a method for adjusting an obfuscation of an image layer.

To adjust the obfuscation of each image layer from the second image layer to the last image layer, the image processing module 13 first obtains "K" reference pixels for each pixel of the image layer. As illustrated in FIG. 2, there are eight reference pixels for each pixel. Each pixel is located at a center of the K reference pixels. The K reference pixels are arranged equally along a horizontal direction and vertical direction of the display, with an equal number "W" of reference pixels on each side of the pixel. Thus, a number of the reference pixels along the horizontal direction and the vertical direction on each side of each pixel equals 2*W, and K equals 4*W.

The image processing module can calculate an average (R, G, B) value of each pixel from the K reference pixels. FIG. 2 illustrates the K reference pixels for a pixel A and a pixel B. The reference pixels of pixel A include reference pixels A1-A8. When the pixel is located at a border of the display or adjacent to the border, a number of times of counting the (R, G, B) value of the reference pixels located at the border of the display is equal to a deficit number of the reference pixels along the corresponding horizontal or vertical direction. For example, as illustrated in FIG. 2, the pixel B is located at the border of the display and is missing one reference pixel along the left horizontal direction and two reference pixels along the bottom vertical direction. To compensate the missing reference pixels, the (R, G, B) value of a reference pixel located at the border of the display along the left horizontal direction is counted twice, and the (R, G, B) value of the pixel B located at the border of the display is counted three times. The obfuscation of the pixels can be adjusted by setting the (R, G, B) value of each pixel to the average (R, G, B) value of the reference pixels. The larger the value for W is, the greater the obfuscation effect is. In at least one embodiment, the value for W can be preset. In other embodiments, the value for W can be set by a user.

To adjust the saturation of each image layer from the second image layer to the last image layer, the image processing module first reduces the saturation of the second image layer by a predetermined proportion "t". The rest of the image layers can be processed according to the following formula:

$$[t-(i-2)*\Delta t]$$

wherein:

$t<1$;

$\Delta t$ is a predetermined step reduction value oft for each consecutive image layer after the second image layer;

i is an integer and equals a sequence number of the image layer; and $\Delta t<t/(n-2)$.

To adjust the transparency of each image layer from the first image layer to the last image layer, the image layers can be processed by known processing means in the art.

Figure 3:
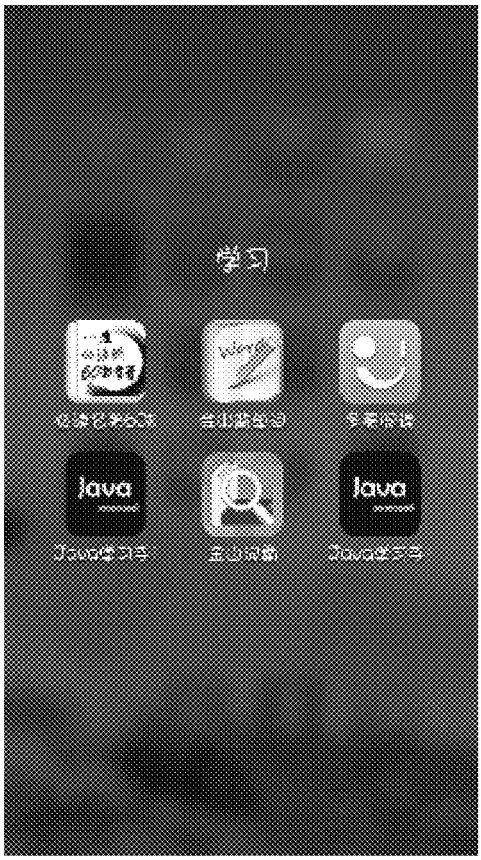
FIG. 3 is a diagrammatic view of an embodiment of the graphical user interface.

Referring to FIG. 3, after all of the image layers have been processed, the displaying module can display the graphical user interface on the display. The image layers of the graphical user interface can have a 3-D effect of being layered on top of each other. Thus, the graphical user interface can be more intuitive for a user to operate.

Figure 4:
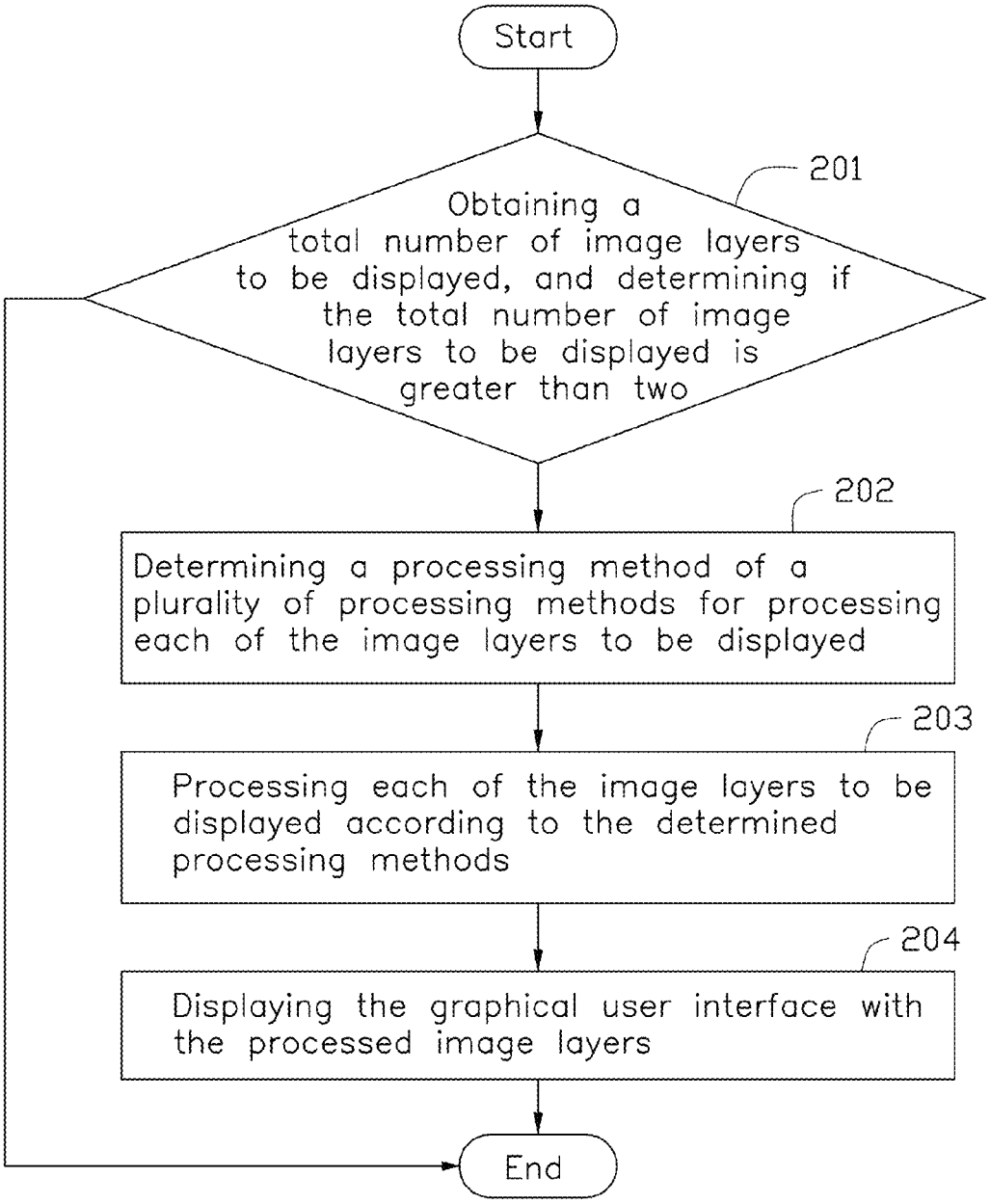
FIG. 4 is a flowchart of an embodiment of a method for displaying a graphical user interface on a display of an electronic device.

FIG. 4 illustrates a flowchart of an exemplary method for displaying a graphical user interface on a display of an electronic device. The example method is provided by way of example, as there are a variety of ways to carry out the method. The method described below can be carried out using the configurations illustrated in FIGS. 1-3, for example, and various elements of these figures are referenced in explaining the example method. Each block shown in FIG. 4 represents one or more processes, methods, or subroutines carried out in the example method. Furthermore, the illustrated order of blocks is by example only, and the order of the blocks can be changed. Additional blocks may be added or fewer blocks may be utilized, without departing from this disclosure. The example method can begin at block 201.

At block 201, a total number of image layers to be displayed can be obtained. If the total number of image layers to be displayed is greater than two, block 202 is implemented. Otherwise, if the total number of image layers is less than or equal to two, the method ends.

At block 202, a processing method of a plurality of processing methods for processing each of the image layers to be displayed can be determined. The processing methods can include size adjustment, obfuscation adjustment, saturation adjustment, and transparency adjustment.

At block 203, each of the image layers to be displayed can be processed according to the determined processing methods. In at least one embodiment, each image layer from a second image layer to a second to last image layer is processed by size adjustment, each image layer from the second image layer to the last image layer is processed by obfuscation adjustment, each image layer from the second image layer to the last image layer is processed by saturation adjustment, and each image layer from a first image layer to the last image layer is processed by transparency adjustment.

At block 204, the graphical user interface with the processed image layers can be displayed on the display.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A method for displaying a graphical user interface on a display of an electronic device, the method comprising:

obtaining a total number "n" of image layers to be displayed on the display, and determining whether the total number of image layers is greater than two;

when the total number of image layers is greater than two, determining a processing method from a plurality of processing methods for processing each image layer to display each image layer, according to the total number of image layers to be displayed, wherein the plurality of the processing methods comprises size adjustment, saturation adjustment, obfuscation adjustment, and transparency adjustment;

wherein a method of adjusting the size of each of the image layers from a second image layer to a second to last image layer comprises:

reducing the size of the second image layer by a predetermined proportion "r"; and reducing the size of the rest of the image layers by the following formula:

$$[r-(i-2)*\Delta r]$$

wherein:

$r<1$:

$\Delta r$ is a predetermined step reduction value of r for each consecutive image layer after the second image layer;

i is an integer and equals a sequence number of the image layer;

$2\leq i\leq n-1$; and $\Delta r<r/(n-2)$;

processing each image layer according to the determined processing method; and displaying the graphical user interface on the display after all of the image layers have been processed.

2. The method as in claim 1, wherein:

a first image layer is a top-most image layer being operable by a user, a last image layer is a wallpaper of the graphical user interface, and a second to last image layer is a plurality of icons on the wallpaper.

3. The method as in claim 1, wherein:

each of the image layers from the second image layer to the second to last image layer is processed by size adjustment;

each of the image layers from the second image layer to the last image layer is processed by obfuscation and saturation adjustment;

each of the image layers from a first image layer to the last image layer is processed by transparency adjustment.

4. The method as in claim 3, wherein a method of adjusting the obfuscation of each of the image layers from the second image layer to the last image layer comprises:

obtaining "K" reference pixels for each pixel of the image layer;

calculating an average (R, G, B) value of each pixel from the (R, G, B) values of the K reference pixels; and displaying each pixel with the average (R, G, B) value calculated from the K reference pixels of the pixel.

5. The method as in claim 4, wherein:

each pixel is located at a center of the K reference pixels;

K equals 4*W, and W is a positive integer;

the K reference pixels are arranged equally along a horizontal direction and a vertical direction of the display, with an equal number of reference pixels on each side of the pixel;

a number of the reference pixels along the horizontal direction and the vertical direction on each side of each pixel equals 2*W;

when the average (R, G, B) values of the pixels located at a border of the display or adjacent to the border are calculated, a number of times of counting the (R, G, B) value of the reference pixels located at the border of the display is equal to a deficit number of the reference pixels along the corresponding horizontal or vertical direction.

6. The method as in claim 5, wherein a value of W is preset.

7. The method as in claim 5, wherein a value of W is set by a user.

8. The method as in claim 3, wherein a method of adjusting the saturation of each of the image layers from the second image layer to the last image layer comprises:

reducing the saturation of the second image layer by a predetermined proportion "t"; and reducing the saturation of the rest of the image layers by the following formula:

$$[t-(i-2)*\Delta t]$$

wherein:

$t<1$;

$\Delta t$ is a predetermined step reduction value oft for each consecutive image layer after the second image layer;

i is an integer and equals a sequence number of the image layer; and $\Delta t<t/(n-2)$.

9. An electronic device capable of displaying a graphical user interface, the electronic device comprising:

a display configured for displaying the graphical user interface thereon; and at least one processing device configured to obtain a total number "n" of image layers to be displayed on the graphical user interface;

determine a processing method of a plurality of processing methods for processing each of the total number of image layers when the total number of the image layers to be displayed on the graphical user interface is greater than two, wherein the plurality of processing methods comprises size adjustment, saturation adjustment, obfuscation adjustment, and transparency adjustment;

wherein a method of adjusting the size of each of the image layers from a second image layer to a second to last image layer comprises:

reducing the size of the second image layer by a predetermined proportion "r"; and reducing the size of the rest of the image layers by the following formula:

$$[r-(i-2)*\Delta r]$$

wherein:

$r<1$:

$\Delta r$ is a predetermined step reduction value of r for each consecutive image layer after the second image layer;

i is an integer and equals a sequence number of the image layer;

$2\leq i\leq n-1$; and $\Delta r<r/(n-2)$;

process each image layer according to the processing method determined by the processing device; and display each of the image layers after being processed.

10. The electronic device as in claim 9, wherein:

a first image layer is a top-most image layer being operable by a user, a last image layer is a wallpaper of the graphical user interface, and a second to last image layer is a plurality of icons on the wallpaper.

11. The electronic device as in claim 9, wherein:

each of the image layers from the second image layer to the second to last image layer is processed by size adjustment;

each of the image layers from the second image layer to the last image layer is processed by obfuscation and saturation adjustment;

each of the image layers from a first image layer to the last image layer is processed by transparency adjustment.

12. The electronic device as in claim 11, wherein the processing device adjusts the obfuscation of each of the image layers from the second image layer to the last image layer by:

obtaining "K" reference pixels for each pixel of the image layer;

calculating an average (R, G, B) value of each pixel from the (R, G, B) values of the K reference pixels; and displaying each pixel with the average (R, G, B) value calculated from the K reference pixels of the pixel.

13. The electronic device as in claim 12, wherein:

each pixel is located at a center of the K reference pixels;

K equals 4*W, and W is a positive integer;

the K reference pixels are arranged equally along a horizontal direction and a vertical direction of the display, with an equal number of reference pixels on each side of the pixel;

a number of the reference pixels along the horizontal direction and the vertical direction on each side of each pixel equals 2*W;

when the average (R, G, B) values of the pixels located at a border of the display or adjacent to the border are calculated, a number of times of counting the (R, G, B) value of the reference pixels located at the border of the display is equal to a deficit number of the reference pixels along the corresponding horizontal or vertical direction.

14. The electronic device as in claim 13, wherein a value of W is preset.

15. The electronic device as in claim 13, wherein a value of W is set by a user.

16. The electronic device as in claim 11, wherein the image processing module adjusts the saturation of each of the image layers from the second image layer to the last image layer by:

reducing the saturation of the second image layer by a predetermined proportion "t"; and reducing the saturation of the rest of the image layers by the following formula:

$$[t-(i-2)*\Delta t]$$

wherein:

$t<1$;

$\Delta t$ is a predetermined step reduction value oft for each consecutive image layer after the second image layer;

i is an integer and equals a sequence number of the image layer; and $\Delta t<t/(n-2)$.

* * * * *